US008907198B2

(12) United States Patent
Juszkiewicz

(10) Patent No.: US 8,907,198 B2
(45) Date of Patent: Dec. 9, 2014

(54) ELECTRIC STRINGED MUSICAL INSTRUMENT STANDARD ELECTRONIC MODULE

(75) Inventor: Henry E. Juszkiewicz, Nashville, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

(21) Appl. No.: 13/882,177

(22) PCT Filed: Oct. 28, 2011

(86) PCT No.: PCT/US2011/058451

§ 371 (c)(1),
(2), (4) Date: Jun. 21, 2013

(87) PCT Pub. No.: WO2012/058631

PCT Pub. Date: May 3, 2012

(65) Prior Publication Data

US 2013/0298751 A1 Nov. 14, 2013

Related U.S. Application Data

(60) Provisional application No. 61/407,769, filed on Oct. 28, 2010.

(51) Int. Cl.
*G10H 1/18* (2006.01)

(52) U.S. Cl.
USPC ..... 84/644; 84/718; 84/742

(58) Field of Classification Search
USPC ..... 84/644, 718, 742
See application file for complete search history.

(56) References Cited

U.S. PATENT DOCUMENTS

| | | | | | |
|---|---|---|---|---|---|
| 3,483,303 | A | * | 12/1969 | Warner | 84/728 |
| 3,742,113 | A | * | 6/1973 | Cohen | 84/726 |
| 4,152,671 | A | * | 5/1979 | Tuma et al. | 331/68 |
| 4,186,641 | A | * | 2/1980 | Dorfman | 84/723 |
| 4,215,796 | A | * | 8/1980 | Johnston et al. | 220/4.23 |
| 4,425,831 | A | * | 1/1984 | Lipman | 84/743 |
| 4,472,994 | A | * | 9/1984 | Armstrong | 84/726 |
| 4,539,886 | A | * | 9/1985 | Hoffart | 84/267 |
| 4,711,149 | A | * | 12/1987 | Starr | 84/742 |
| 4,765,219 | A | * | 8/1988 | Alm | 84/726 |
| 4,829,432 | A | * | 5/1989 | Hershberger et al. | 361/818 |
| 4,922,382 | A | * | 5/1990 | Hobbins | 361/818 |
| 4,948,923 | A | * | 8/1990 | Suzuki | 174/372 |
| 5,052,269 | A | * | 10/1991 | Young, Jr. | 84/728 |
| 5,189,241 | A | * | 2/1993 | Nakamura | 84/728 |
| 5,353,201 | A | * | 10/1994 | Maeda | 361/816 |
| 5,391,833 | A | * | 2/1995 | Clement | 84/742 |
| H1503 | H | * | 12/1995 | Threadgill | 84/723 |
| 5,483,423 | A | * | 1/1996 | Lewis et al. | 361/816 |
| 5,656,876 | A | * | 8/1997 | Radley et al. | 307/150 |
| 5,696,669 | A | * | 12/1997 | Bassler et al. | 361/816 |
| 6,043,422 | A | * | 3/2000 | Chapman | 84/723 |

(Continued)

*Primary Examiner* — David S. Warren
(74) *Attorney, Agent, or Firm* — Bates & Bates, LLC

(57) ABSTRACT

A standard electronic module for an electric stringed musical instrument is provided. The standard electronic module is mounted within the main body of the electric stringed musical instrument in a module cavity in the back of the electric stringed musical instrument. The standard electronic module comprises two printed circuit boards, a main printed circuit board and a connector circuit board, wherein the standard electronic module provides rapid exchange of the main printed circuit board without changing the wiring harness of the electric stringed musical instrument, which is directly connected to the connector printed circuit board.

20 Claims, 10 Drawing Sheets

(56) References Cited

U.S. PATENT DOCUMENTS

| | | | | |
|---|---|---|---|---|
| 6,049,468 | A * | 4/2000 | Learmonth | 361/816 |
| 6,088,231 | A * | 7/2000 | Fajardo | 361/737 |
| 6,169,666 | B1 * | 1/2001 | Venant | 361/816 |
| 6,191,950 | B1 * | 2/2001 | Cox et al. | 361/737 |
| 6,323,418 | B1 * | 11/2001 | Tiburtius et al. | 174/387 |
| 6,336,367 | B1 * | 1/2002 | Raisanen | 73/632 |
| 6,418,036 | B1 * | 7/2002 | Rodrigues | 361/816 |
| 6,439,927 | B1 * | 8/2002 | Peter et al. | 439/607.58 |
| 6,674,652 | B2 * | 1/2004 | Forte et al. | 361/800 |
| 6,800,800 | B1 * | 10/2004 | Giordano et al. | 84/726 |
| 6,822,161 | B2 * | 11/2004 | Komatsu et al. | 174/367 |
| 7,005,573 | B2 * | 2/2006 | Lionetta et al. | 174/387 |
| 7,105,731 | B1 * | 9/2006 | Riedl | 84/200 |
| 7,197,149 | B1 * | 3/2007 | Mita et al. | 381/98 |
| 7,256,343 | B2 * | 8/2007 | Brubaker et al. | 84/743 |
| 7,442,881 | B1 * | 10/2008 | Chien | 174/382 |
| 7,476,798 | B1 * | 1/2009 | Beller et al. | 84/743 |
| 7,643,310 | B2 * | 1/2010 | Long | 361/816 |
| 7,709,749 | B2 * | 5/2010 | Meier | 174/377 |
| 7,916,500 | B2 * | 3/2011 | Shi et al. | 361/816 |
| 8,039,764 | B2 * | 10/2011 | Yang | 174/377 |
| 8,149,594 | B2 * | 4/2012 | Nishihata | 361/818 |
| 8,169,786 | B2 * | 5/2012 | Mangaroo | 361/752 |
| RE43,519 | E * | 7/2012 | Gnecco et al. | 381/322 |
| 8,213,182 | B2 * | 7/2012 | Aoki et al. | 361/752 |
| 8,294,043 | B2 * | 10/2012 | Munoz et al. | 174/359 |
| 8,455,750 | B1 * | 6/2013 | Severson | 84/743 |
| 8,614,389 | B2 * | 12/2013 | Wallace et al. | 84/733 |
| 2001/0002877 | A1 * | 6/2001 | Alina et al. | 361/800 |
| 2002/0104670 | A1 * | 8/2002 | Marmel | 174/35 R |
| 2004/0074380 | A1 * | 4/2004 | Fishman | 84/741 |
| 2005/0088835 | A9 * | 4/2005 | Beihoff et al. | 361/818 |
| 2006/0086518 | A1 * | 4/2006 | Kawaguchi et al. | 174/35 R |
| 2006/0174753 | A1 * | 8/2006 | Aisenbrey | 84/600 |
| 2006/0217792 | A1 * | 9/2006 | Hussein et al. | 607/122 |
| 2008/0245561 | A1 * | 10/2008 | Meier | 174/357 |
| 2009/0032300 | A1 * | 2/2009 | Joshi | 174/377 |
| 2009/0120682 | A1 * | 5/2009 | Ohtsuji et al. | 174/359 |
| 2009/0211800 | A1 * | 8/2009 | Tsao et al. | 174/377 |
| 2011/0255250 | A1 * | 10/2011 | Dinh et al. | 361/749 |
| 2012/0281386 | A1 * | 11/2012 | Kim | 361/818 |
| 2012/0298414 | A1 * | 11/2012 | Park | 174/382 |
| 2013/0201623 | A1 * | 8/2013 | Ellis | 361/679.46 |
| 2013/0284510 | A1 * | 10/2013 | Lo et al. | 174/377 |
| 2013/0298751 | A1 * | 11/2013 | Juszkiewicz | 84/743 |
| 2013/0308284 | A1 * | 11/2013 | Ou | 361/752 |
| 2013/0329381 | A1 * | 12/2013 | Huang et al. | 361/748 |
| 2014/0060290 | A1 * | 3/2014 | Wallace et al. | 84/733 |

* cited by examiner

ELECTRIC STRINGED MUSICAL INSTRUMENT STANDARD ELECTRONIC MODULE

CROSS-REFERENCE TO RELATED APPLICATION

This Application claims priority to U.S. Provisional Patent Application Ser. No. 61/407,769, filed Oct. 28, 2010, and PCT Patent Application No. PCT/US2011/058451, filed Oct. 28, 2011, both of which are hereby incorporated by reference in their entirety.

TECHNICAL FIELD

The field of the disclosure relates generally to the use of a standard electronic module in electric stringed musical instruments, such as an electric guitar. More particularly, the disclosure relates to a standard electronic module constructed of a battery component, digital signal processor/printed circuit board, shield box, and printed circuit board wire harness which is fitted into a cavity in an electronic stringed musical instrument body.

BACKGROUND

As electrical stringed musical instruments become more sophisticated, the electronics of the instruments are controlled largely by computer processors. These processors allow instruments to mimic the tonality, loudness, reverberation and timbre of almost any electronic component. Unlike the electric stringed musical instruments of the past, where changes of on-board electronics were largely the only method of changing the sound of a particular instrument, computerized electronics can allow changes of the sound of an instrument without changing out the electronics or buying a new instrument. However, changing computerized processors of electrical stringed instruments generally requires technical assistance that is costly and time-consuming, or a level of technical expertise beyond that of most musicians.

Therefore, a need exists for a standard electronics module for providing simple and rapid electronic exchange, wherein such a module could be placed into a cavity formed in the instrument body and provide control of all of the electric stringed musical instrument electronics.

SUMMARY

In one aspect, the present disclosure is directed toward a standard electronic module for an electric stringed musical instrument comprising a shield box; a main printed circuit board within the shield box, wherein the main printed circuit board comprises at least one connecting mate, further wherein the connecting mate allows electrical connection of the main printed circuit board to a connector printed circuit board; and a battery compartment connected with the shield box, wherein the standard electronic module fits into an integral module cavity within the main body of the electric stringed musical instrument.

The standard electronic module allows different electronic packages to be used in a single electric stringed musical instrument without rewiring the electronics or changing other hardware, such as switches or pickups. This allows a user to quickly change or update the electronics of a specific electric stringed musical instrument without having to purchase anything beyond an updated main printed circuit board or main printed circuit board plus shield box.

Consistent with yet a further aspect of the disclosure, a guitar with the disclosed standard electronic module is claimed.

DETAILED DESCRIPTION

Before describing the exemplary embodiments in detail, it is to be understood that the embodiments are not limited to particular apparatuses or methods, as the apparatuses and methods can, of course, vary. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which an embodiment pertains. Many methods and materials similar, modified, or equivalent to those described herein can be used in the practice of the current embodiments without undue experimentation.

As used in this specification and the appended claims, the singular forms "a", "an" and "the" can include plural referents unless the content clearly indicates otherwise. Thus, for example, reference to "a component" can include a combination of two or more components.

Figure 1:
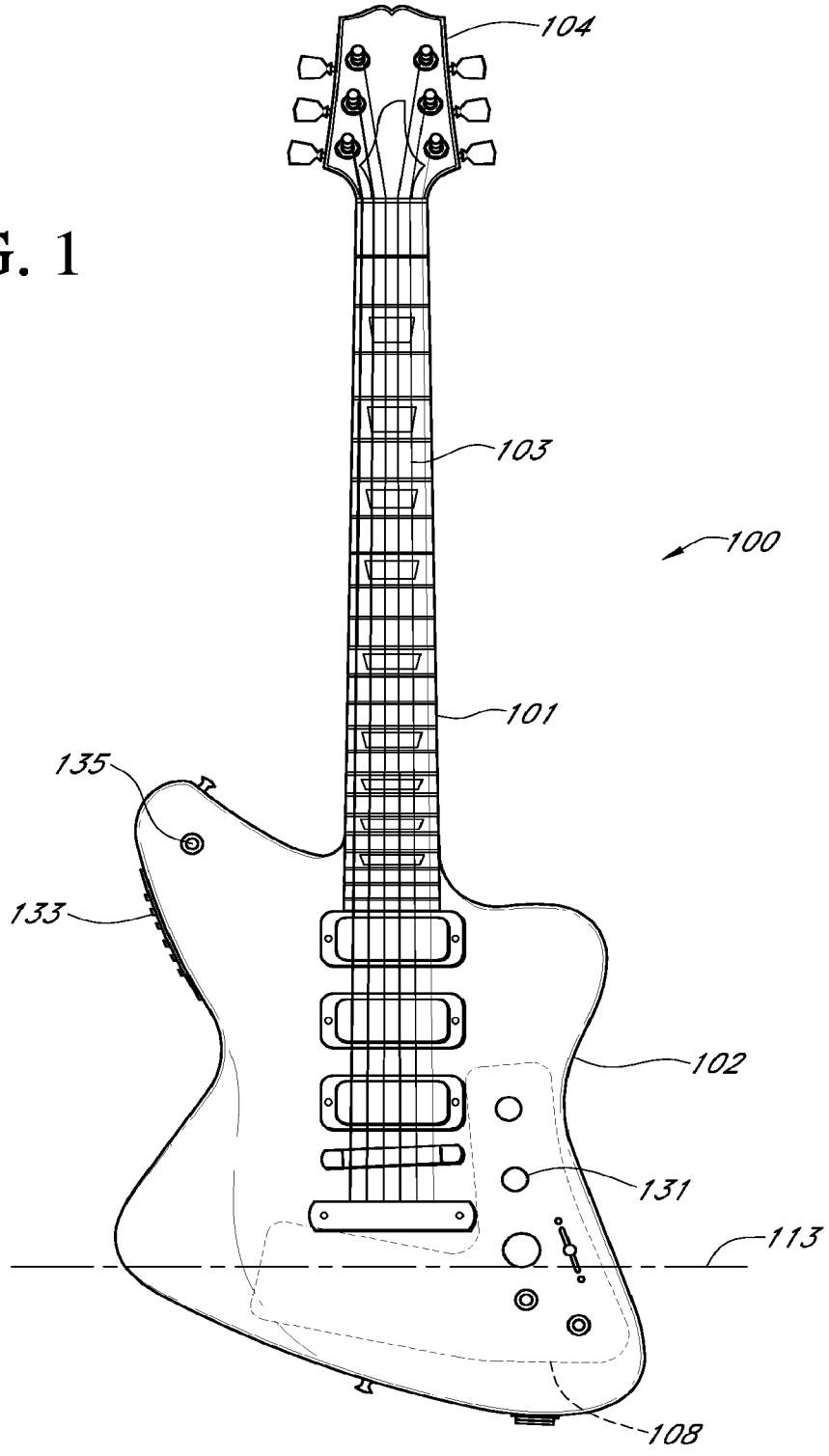
FIG. 1 depicts a plan view of a guitar used with the standard electronic module. The dotted lines represent the module cavity in the back of the guitar.

Exemplary embodiments of the standard electronic module will now be explained with reference to the figures. This description is provided in order to assist in the understanding of the invention and is not intended to limit the scope of the invention to the embodiments shown in the figures or described below. FIG. 1 demonstrates an electric stringed musical instrument. In the embodiment of FIG. 1, the electric stringed musical instrument is a six stringed guitar. However, the components and advantages currently disclosed are applicable to other types of stringed electrical instruments, such as bass guitars, ukuleles, mandolins, violins or guitars with a different number of strings. Referring now to FIG. 1, guitar 100 comprises a neck 101 and a main body 102. The guitar 100 includes guitar strings 103 that are secured on one end to a tuning head 104 and on the other end to a bridge 105 in a manner well known in the art. The electric stringed musical instrument also includes switches 135, a master control knob 131, and faders 133. As shown by the broken lines in FIG. 1, guitar 100 also comprises at least one rear-entry cavity for the electronics. Standard electronic module 107 fits into one of these rear-entry cavities, the module cavity 108.

Figure 2:
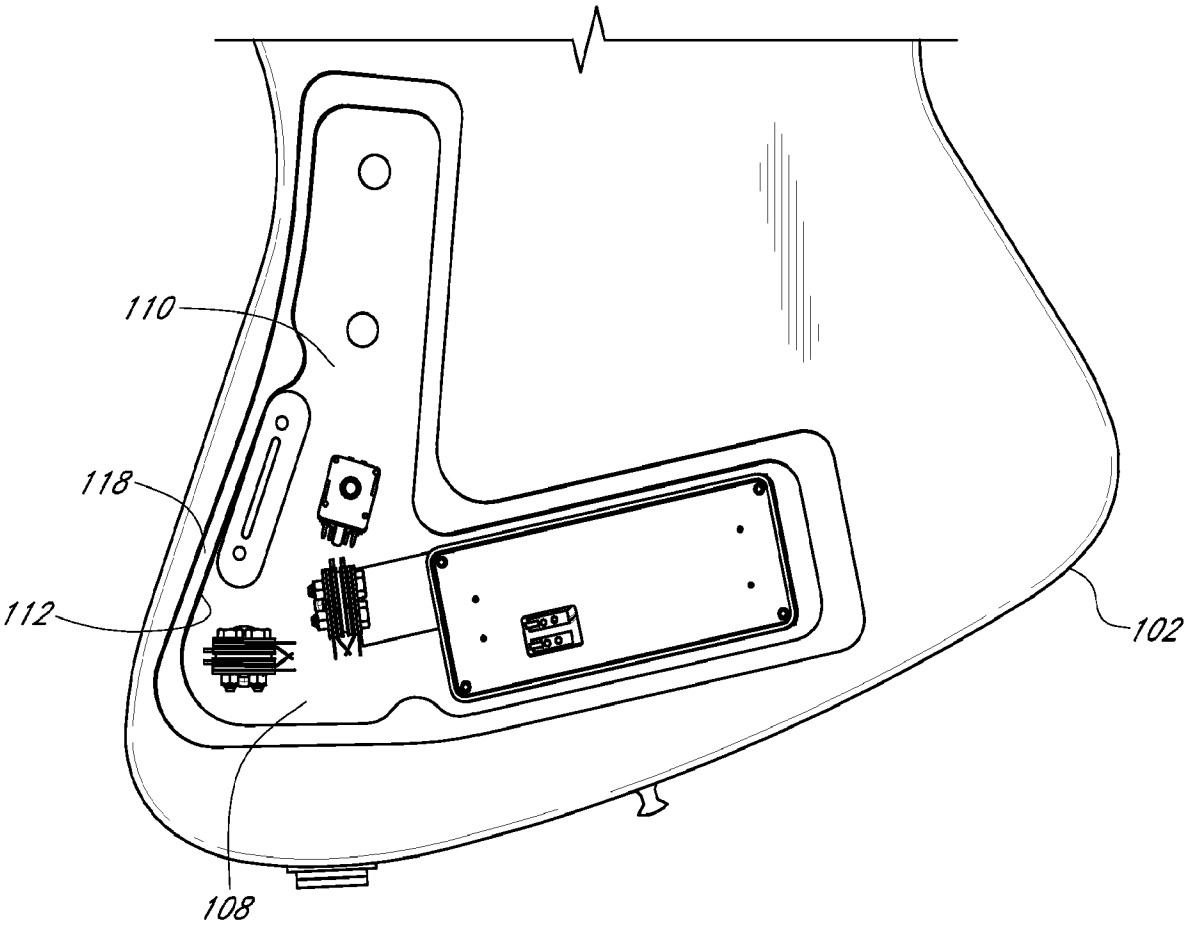
FIG. 2 illustrates the module cavity in the back of the guitar with the standard electronic module and additional wiring.

Module cavity 108 is shown in further detail in FIG. 2. In many embodiments, module cavity 108 will be milled into the back of the electric stringed musical instruments in a position in the bottom of the main body 102. In certain embodiments, module cavity 108 is about 1.3 inches from the bottom edge of main body 102. Module cavity 108 does not extend all the way through main guitar body 102 to the front of the guitar. In some embodiments, module cavity 108 extends through main body 102 such that the depth between the front of main body 102 and the floor 110 of module cavity 108 is 0.2 inches. As is understood by the skilled artisan, each module cavity 108 is appropriately dimensioned so as to accommodate receipt of the standard electronic module.

Figure 3:
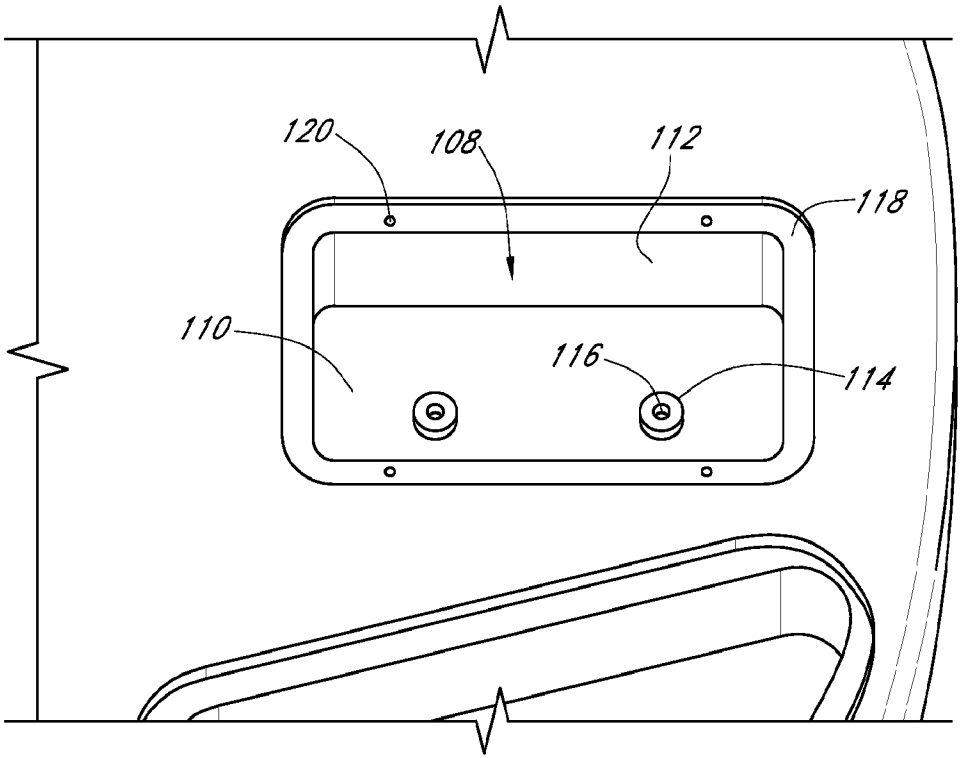
FIG. 3 is an enlarged view of a module cavity embodiment.

Module cavity 108 includes a floor 110 and at least one lateral wall 112 within main guitar body 102. In exemplary embodiments, floor 110 of module cavity 108 has at least one projection 114 (demonstrated in the alternative module cavity of FIG. 3). Projection 114 may comprise a threaded aperture to assist in securing the standard electronic module to the guitar. In the embodiment of FIG. 3, threaded aperture 116 in projection 114 can receive a screw. Projection 114 is tubular in shape in FIG. 3. However, other projections, including those that are cubical in shape as well as those containing apertures which can receive other fasteners such as pins are contemplated. Module cavity 108 further includes a recessed upper edge 118. In many cases, recessed upper edge 118 has apertures 120 suited to receive fasteners. Module cavity 108 of FIG. 3 demonstrates four fastener apertures 120 in recessed upper edge 118 but as is understood by the skilled artisan, the number of fastener apertures 120 is not limiting and may include one or more fastener apertures. Lateral walls 112 of module cavity 108 include at least one opening (not shown) to allow for connection of electronic wires with the connector printed circuit board 126 (connector PCB). This opening is not limited and may be any size or shape adequate to allow the electronic wires of the stringed electronic instrument to connect to connector PCB 126.

Figure 4:
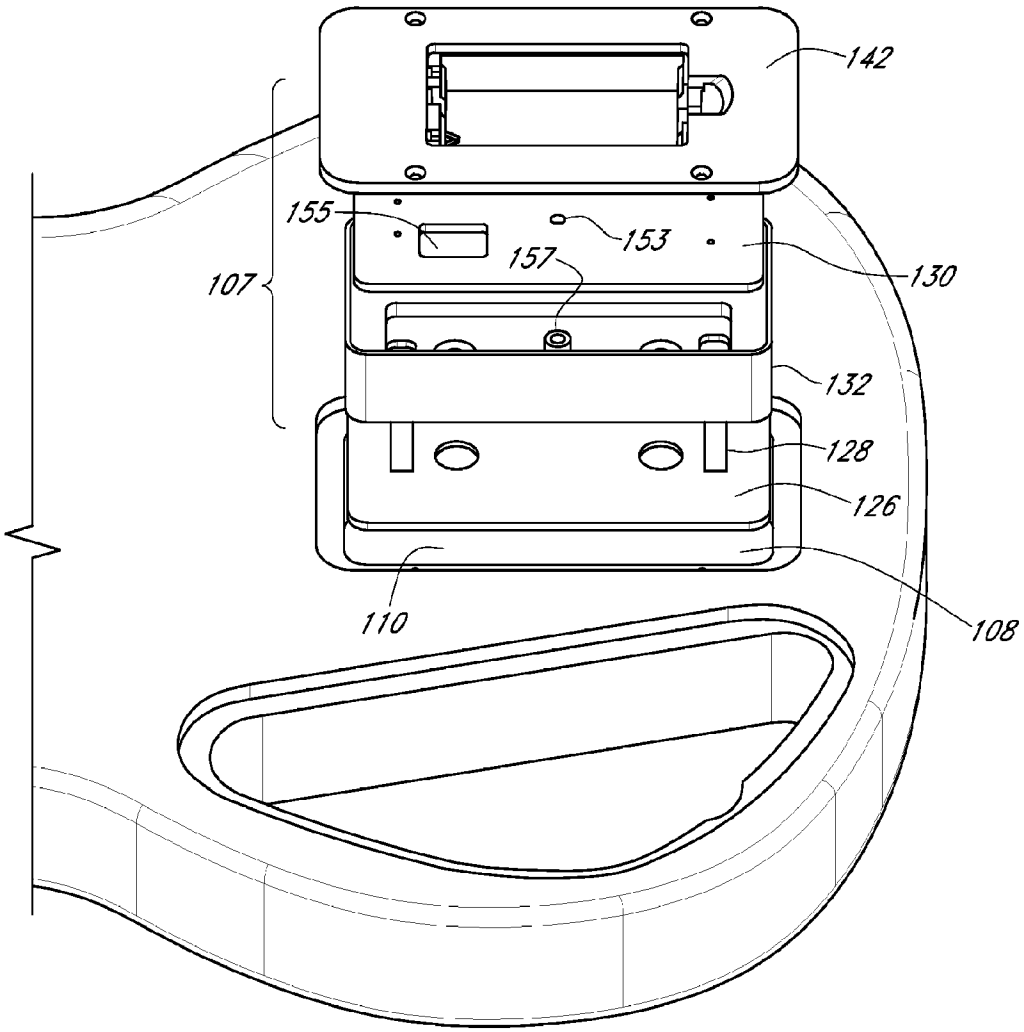
FIG. 4 demonstrates a perspective view of the installation of the standard electronic module and connector PCB into the module cavity.
Figure 5:
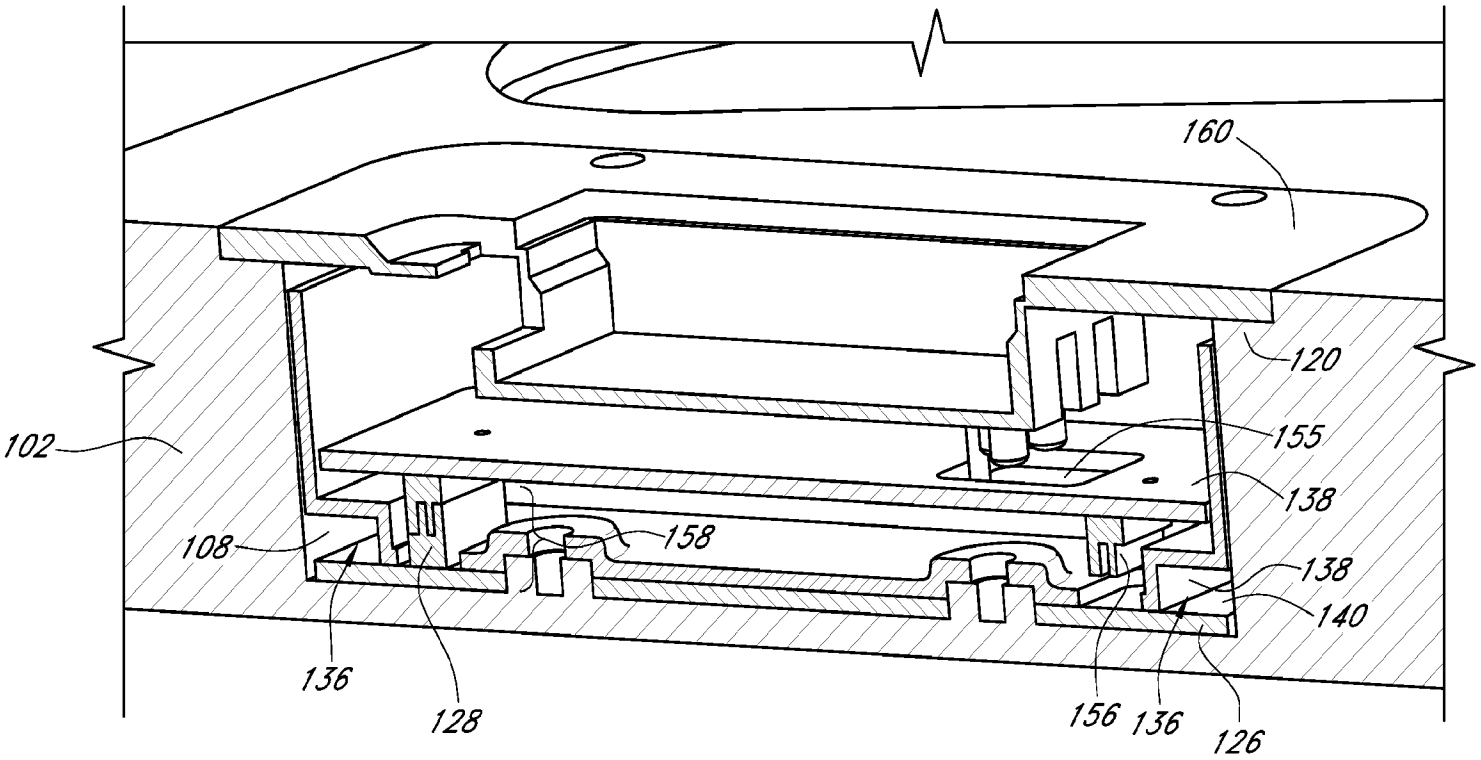
FIG. 5 illustrates a view of the standard electronic module and connector PCB installed in the module cavity in the bottom of the main body of the guitar.

Connector PCB 126 fits into module cavity 108 as demonstrated by FIG. 4. Generally connector PCB 126 is not exchanged during exchange of the main printed circuit board; nevertheless, there may be instances where changing connector PCB 126 is preferable. In the embodiment demonstrated in FIG. 4, connector PCB 126 directly associates with floor 110 of module cavity 108. Connector PCB 126 directly connects to the wire harness for the electronic wiring of electric stringed musical instrument and comprises at least one connecting mate 128, which allows association of connector PCB 126 with main printed circuit board 130 (main PCB). Connector PCB 126 includes wire to board connections for most of the guitar electronics, including the switches, toggle-potentiometers, pickups and faders. In some embodiments, connector PCB 126 contains the antenna circuitry for wireless control. As the skilled artisan readily understand, this list of wire to board connections is not meant to be limiting and can also comprise additional connections. As shown in FIG. 5, connector PCB 126 is held in place in module cavity 108 by shield box 132 and connecting mate 128. Cavities 136 formed by the walls of recessed cavity 144 of shield box 132 and top 140 of connector PCB 126 provide space for the internal electronic connections and wiring, i.e. the cable harness.

Standard electronic module 107 containing main PCB 130 is shown removed from the electric stringed musical instrument main body 102 in FIG. 4. Standard electronic module 107 is an integral part of the electric stringed musical instrument. Standard electronic module 107 comprises shield box 132, at least one connecting mate 128, main PCB 130, and a battery compartment 142. In many embodiments, connector PCB 126 is additionally part of the standard electronic module. Shield box 132 is demonstrated in FIG. 5 and is connected with main body 102 in module cavity 108. Shield box 132 is made of material capable of blocking electromagnetic interference. In one embodiment, shield box 132 is made from aluminum. Shield box 132 is 115 mm by 47 mm in an exemplary embodiment. Shield box 132 fits into module cavity 108 adjacent to connector PCB 126. In one embodiment, shield box 132 is shaped such as the exemplary shield box in FIG. 5. However, different shaped shield boxes, such as those that are oval or circular are contemplated.

Figure 6A:
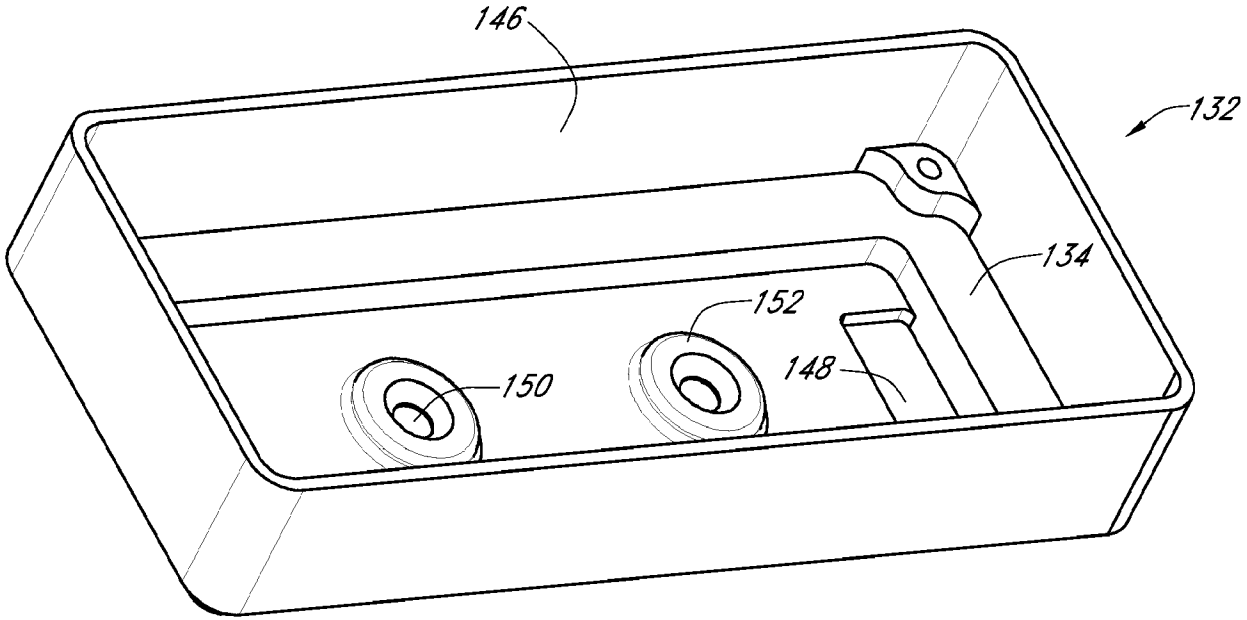
FIG. 6 is a view of the inside and outside of the shield box of the standard electronic module.
Figure 6B:
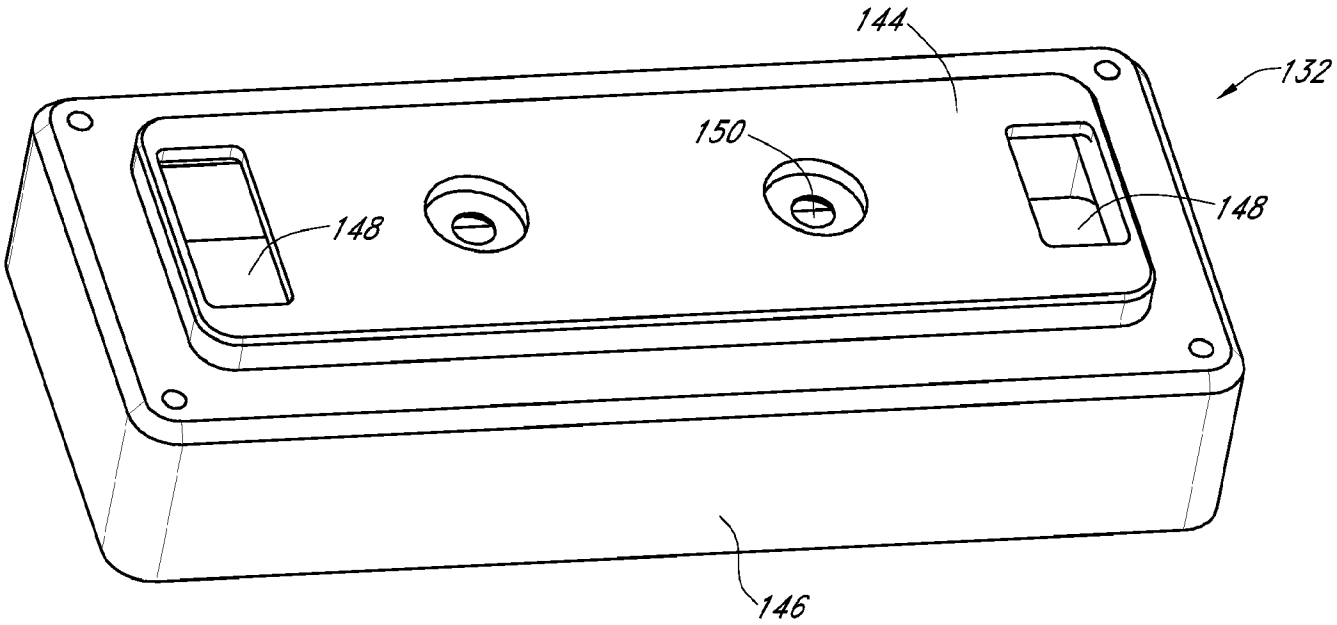

As demonstrated in FIG. 6, shield box 132 includes floor 134 with recessed cavity 144. In an exemplary embodiment, recessed cavity 144 is about 3 mm in depth. Shield box 132 further includes at least one lateral wall 146. In alternative embodiments, lateral wall 146 of shield box 132 is constructed to fix snuggly with lateral wall 112 of module cavity 108. Recessed cavity 144 in floor 134 of shield box 132 includes at least one opening 148 adapted to accommodate the connection between connector PCB 126 and main PCB 130. In the exemplary embodiment of FIG. 6, opening 148 is rectangular in shape. However, the shape of opening 128 is not limiting and may be any shape adapted to accommodate an appropriate connection between connector PCB 126 and main PCB 130. For example, in one embodiment, opening 128 is circular. Recessed cavity 144 additionally includes at least one opening 150 adapted to correspond with opening 116 in module cavity 108, such that a fastener can attach shield box 132 with main body 102. In many embodiments, opening 150 is in projection 152.

Figure 7A:
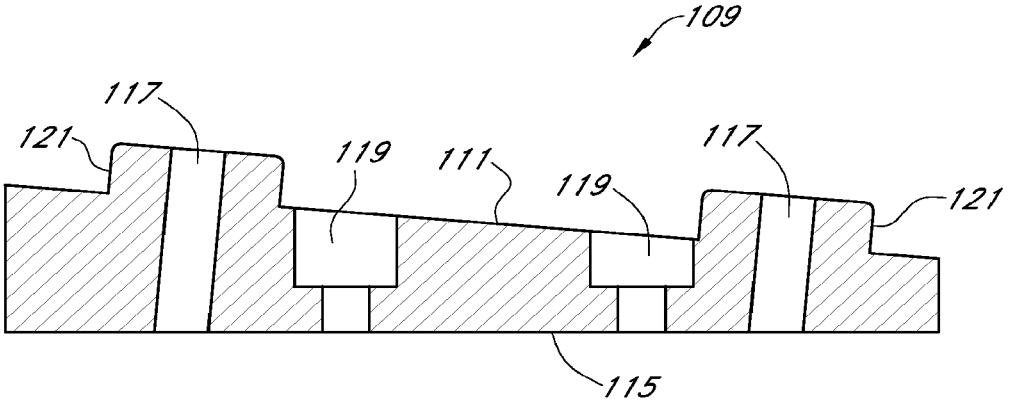
FIG. 7 depicts a side and plan view of a module cavity adapter.
Figure 7B:
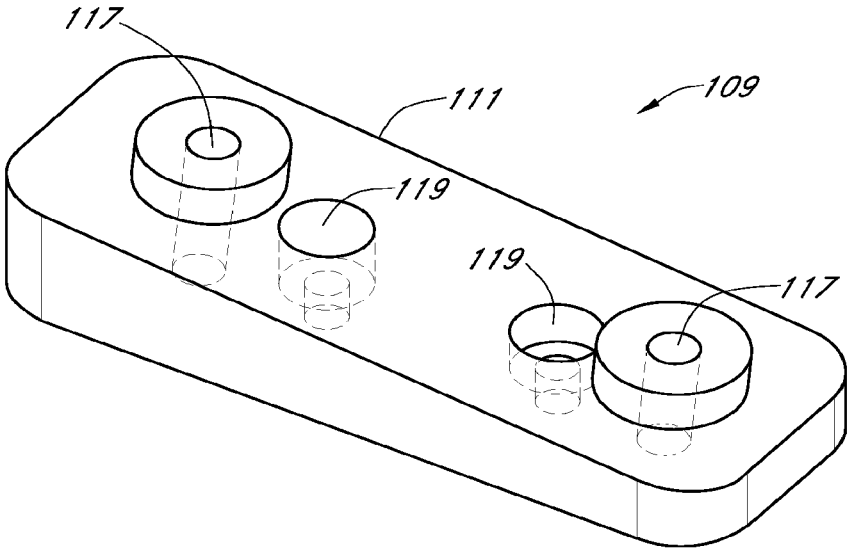

In some embodiments, cavity adapter 109, such as the one shown in FIG. 7 is placed into module cavity 108. In these embodiments, connector PCB 126 is then placed on the top edge 111 of cavity adapter 109 instead of directly on floor 110 of module cavity 108. Cavity adapter 109 shown in FIG. 7 has an angled top edge 111. Therefore, when connector PCB 126 is placed on top edge 111 of cavity adaptor 109, connector PCB 126 will be angled along horizontal axis 113 of main body 102 of electric stringed musical instrument. In the embodiment of FIG. 7, cavity adapter is generally rectangular in shape with rounded edges. Bottom edge 115 of cavity adapter 109 is parallel to the floor 110 of module cavity 108. In an exemplary embodiment, the angle of top edge 111 of cavity adapter 109 is about five degrees as compared to bottom edge 115 of cavity adapter 109. The shape and angle of cavity adapter 109 is not meant to be limiting. Nevertheless, in the embodiment in FIG. 7, cavity adapter 109 is about 55 mm by 20 mm. Any cavity adapter capable of positioning connector PCB 126 above floor 110 of module cavity 108 is contemplated. In certain exemplary embodiments, cavity adapter 109 positions the standard electronic module such that connector PCB 126 is parallel with the back of the electric stringed musical instrument.

Cavity adapter 109 further includes at least one opening 117 for receiving a fastener to secure connector PCB 126 to cavity adapter 109 and also at least one opening 119 for receiving a fastener to secure cavity adapter 109 to floor 110 of module cavity 108. The embodiment demonstrated in FIG. 7 encompasses two openings 117 and two openings 119. In certain embodiments, openings 117 may be in projections 121. Openings 119 may be constructed such that a fastener can be recessed into the opening. Generally opening 117 will be angled and opening 119 will be perpendicular in reference to floor 110.

As illustrated in FIG. 5, main PCB 130 fits within shield box 132. In an exemplary embodiment, main PCB 130 is 100 mm×50 mm. Generally, main PCB 130 is secured in place in shield box 132 by the interaction of connecting mate 156 with connecting mate 128 on connector PCB 126. Main PCB 130 may include a multiplexer, a digital signal processor (DSP), a wireless communication module, a microcontroller unit (MCU), a plurality of analog-to-digital converters (ADCs), and a tailpiece string circuit, as well as at least one connecting mate 156 to connect main PCB 130 with connector PCB 126. In illustrative embodiments, different and additional components may be incorporated into main PCB 130. Main PCB 130 additionally comprises at least one opening 155 to accommodate positive and negative battery leads, which are connected with a power circuit. In exemplary embodiments, main PCB 130 has opening 153 which lines up with module cavity 108 in projection 157 for a fastener to connect main PCB 130 to shield box 132.

Connecting mate 156 connects main PCB 130 with connector PCB 126. The embodiment of FIG. 5 demonstrates two connector mates 128 and 156 forming connector 158; however, as is well understood by the skilled artisan, the number and shape of the connector mates is not meant to be limiting and any shape/number of connector mates may be used as long as they allow the desired electrical connection between main PCB 130 and connector PCB 126. In one embodiment, two connectors connect main PCB 130 with connector PCB 126. In this embodiment, connectors 158 may be different, i.e. one connector is a 20 pin connector and the other connector is a 60 pin connector. In other embodiments, connectors 158 may be identical.

Figure 8A:
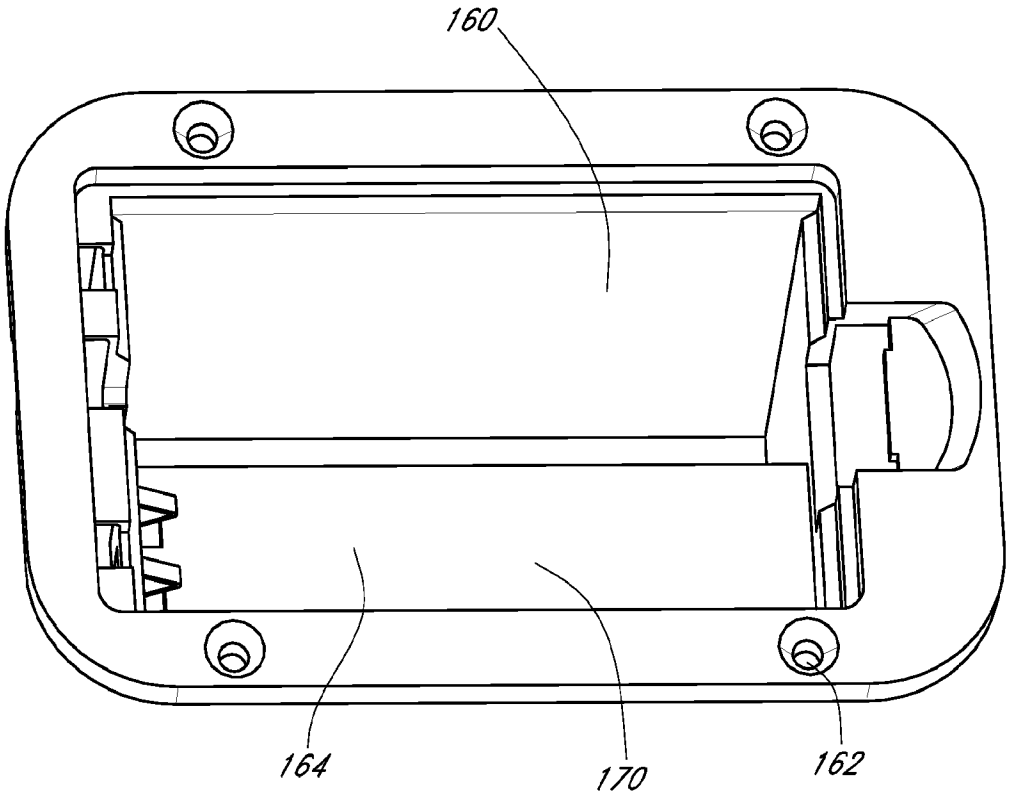
FIGS. 8*a* and 8*b* are plan views of the battery compartment of the standard electronic module.
Figure 8B:
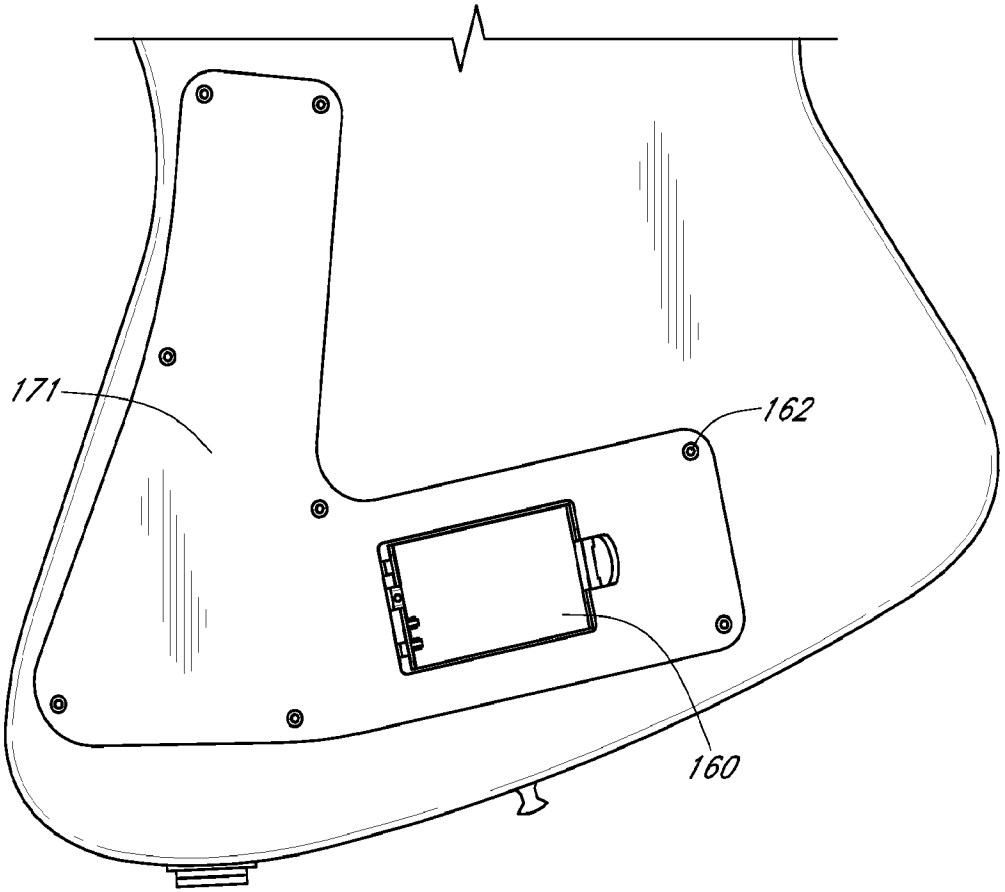

Battery compartment 160 is positioned on recessed upper edge 120 of module cavity 108 in the embodiment in FIG. 8*a*. In most embodiments, battery compartment 160 is attached with module cavity 108 using fasteners (not shown). In the embodiments of FIGS. 8*a* and 8*b*, battery compartment 160 includes at least one threaded opening 162 where a fastener, such as a screw can be threaded through battery compartment 160 and into recessed upper edge 120 of module cavity 108. Battery compartment 160 includes cavity 164, which is designed to accommodate standard batteries. In one embodiment, cavity 164 is designed for a rechargeable lithium ion battery although cavities designed to accommodate other types of batteries are contemplated. Contact connector members 166, 168 are mounted inside battery compartment 160. Battery compartment 160 has positive and negative connectors which electrically engage a battery placed in cavity 164. Contact connector members 166, 168 are in the floor 170 of battery compartment 160 to provide an electrical contact point for the inner electronics. Battery compartment 160 is connected with main body 102 such that batteries may be replaced in standard electronic module 107 without exposing main PCB 130, thus allowing easy accessibility by a user of the electric stringed musical instrument. FIG. 8*b* demonstrates battery compartment 160 as an integral component of back plate 171. Backplate 171 may be any shape complementary to module cavity 108. In the exemplary embodiment illustrated in FIG. 8*a*, there is no additional backplate and battery compartment 160 and backplate 171 are a single component.

Any aspect or design described herein as "exemplary" is not necessarily to be construed as preferred or advantageous over other aspects or designs. Exemplary embodiments may be implemented as a method, apparatus, or article of manufacture. The word "exemplary" is used herein to mean serving as an example, instance, or illustration.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A standard electronic module for an electric stringed musical instrument comprising:

a shield box;

a main printed circuit board within the shield box, wherein the main printed circuit board comprises at least one connecting mate, further wherein the connecting mate allows electrical connection of the main printed circuit board to a connector printed circuit board; and a battery compartment connected with the shield box, wherein the standard electronic module fits into rear-entry integral module cavity within the main body of the electric stringed musical instrument.

2. The standard electronic module of claim 1, wherein the shield box is composed of a shielding metal.

3. The standard electronic module of claim 1, wherein the shield box is aluminum.

4. The standard electronic module of claim 1, wherein the shield box comprises a recessed cavity.

5. The standard electronic module of claim 1, wherein the main printed circuit board has control electronics for processing signals from remote pickups, switches, faders, and toggle-potentiometers.

6. The standard electronic module of claim 1, wherein the main printed circuit board is connected within the shield box by at least one fastener.

7. The standard electronic module of claim 1, wherein the battery component is an integral part of a back plate.

8. The standard electronic module of claim 1, wherein the battery component is connected to the electric stringed musical instrument by at least one fastener.

9. The standard electronic module of claim 1, comprising two connecting mates.

10. The standard electronic module of claim 1, wherein the connecting mate is a pin connector.

11. The standard electronic module of claim 10, wherein the pin connector has a plurality of pins ranging from 20 to 60 in number.

12. The standard electronic module of claim 1, wherein the connector printed circuit board is connected to the floor of the rear-entry integral module cavity.

13. The standard electronic module of claim 1, wherein the connector printed circuit board is connected to a cavity adapter, wherein the cavity adapter is connected to the floor of the rear-entry integral module cavity.

14. The standard electronic module of claim 1, wherein the connector printed circuit board is directly connected to a wire harness of the electric stringed musical instrument.

15. An electric stringed musical instrument with a standard electronic module comprising:

an electric stringed musical instrument main body having a front and a back, wherein the back has a rear-entry integral module cavity defined therein; and a standard electronic module seated in the rear-entry integral module cavity comprising:

a shield box;

a main printed circuit board within the shield box, wherein the main printed circuit board comprises at least one connecting mate, further wherein the connecting mate electrically connects to a connecting mate on an connector printed circuit board; and a battery compartment connected with the shield box.

16. The electric stringed musical instrument of claim 15, wherein the electric stringed musical instrument is a guitar.

17. An electric stringed musical instrument with a standard electronic module comprising:

a guitar body having a front and a back, wherein the back has a rear-entry integral module cavity defined therein; and a standard electronic module seated in the module cavity comprising:

an aluminum shield box comprising a recessed cavity;

a main printed circuit board connected within the shield box by at least one fastener, wherein the main printed circuit board comprises two pin connector connecting mates, yet further wherein the main printed circuit board has control electronics for processing signals from remote pickups, switches, faders, and toggle-potentiometers;

a battery compartment, wherein the battery component is an integral part of a back plate connected with the shield box, further wherein the battery component is connected to the guitar by at least one fastener; and a connector printed circuit board connected to the floor of the rear-entry integral module cavity, wherein the connector printed circuit board is directly connected to the wire harness of the electric stringed musical instrument, further wherein the main printed circuit board connecting mates electrically connect to connecting mates on the connector printed circuit board.

18. The standard electronic module of claim 2, wherein the connector printed circuit board is directly connected to a wire harness of the electric stringed musical instrument.

19. The standard electronic module of claim 5, wherein the connector printed circuit board is directly connected to a wire harness of the electric stringed musical instrument.

20. The standard electronic module of claim 8, wherein the connector printed circuit board is directly connected to a wire harness of the electric stringed musical instrument.

* * * * *